US005852755A

United States Patent [19]

Nakashima

[11] Patent Number: 5,852,755

[45] Date of Patent: Dec. 22, 1998

[54] SYSTEM FOR CONTROLLING CIRCULATION OF DEVELOPING LIQUID

[75] Inventor: Yoshihiko Nakashima, Wakayama, Japan

[73] Assignee: Noritsu Koki Co., Ltd., Wajatana-ken, Japan

[21] Appl. No.: 736,571

[22] Filed: Oct. 24, 1996

[30] Foreign Application Priority Data

Oct. 25, 1995 [JP] Japan ..... 7-277799

[51] Int. Cl.[6] ..... G03D 3/02

[52] U.S. Cl. ..... 396/626; 355/27; 396/630

[58] Field of Search ..... 355/27; 396/578, 396/567, 626, 630; 399/57

[56] References Cited

U.S. PATENT DOCUMENTS

| | | | |
|---|---|---|---|
| 4,023,190 | 5/1977 | Fassler | 354/319 |
| 4,295,729 | 10/1981 | Kaufmann | 354/324 |
| 4,346,981 | 8/1982 | Kaufmann | 396/626 X |
| 4,362,377 | 12/1982 | Yoshida et al. | 396/626 X |
| 5,179,405 | 1/1993 | Osada | 354/324 |
| 5,184,164 | 2/1993 | Kose | 354/298 |
| 5,424,799 | 6/1995 | Nakamura et al. | 354/324 |
| 5,579,075 | 11/1996 | Hagiwara et al. | 396/626 |
| 5,614,979 | 3/1997 | Itoh | 396/578 |
| 5,633,697 | 5/1997 | Kinoshita | 396/626 |

FOREIGN PATENT DOCUMENTS

| | | |
|---|---|---|
| 0645677 | 3/1995 | European Pat. Off. . |
| 3127824 | 6/1982 | Germany . |
| 2051617 | 1/1981 | United Kingdom . |

OTHER PUBLICATIONS

EPO–Patent Abstracts of Japan; Publ. No. 62246059; Publ. Date Oct. 27, 1987; Applicant Fuji Photo Film Co., Ltd.; Inventor Kurokawa Toshio; Title Photographic Processing Device; Int'l. Class G03D 3/02.

*Primary Examiner*—William Royer
*Attorney, Agent, or Firm*—Fulbright & Jaworski, LLP

[57] ABSTRACT

A developing liquid circulation controlling system includes a circulating pump 61–67 for providing circulation of processing liquid from an upper region of a processing tank 41–47, an auxiliary tank 41*a*–47*a*, a circulating passage 51–57, a lower region of the processing tank and then back to the upper region of the processing tank. The circulating pump provides at least two selectable differing circulation amounts. For providing this, the system includes a use condition detecting sensor 10 for detecting at least two different use conditions of the processing tank, and a controller 100, 101 operatively connected with the sensor. The controller sets the circulating pump to a high circulation amount mode when the sensor detects a first use condition and sets the pump to a low circulation amount mode when the sensor detects a second use condition.

5 Claims, 6 Drawing Sheets

SYSTEM FOR CONTROLLING CIRCULATION OF DEVELOPING LIQUID

BACKGROUND OF THE INVENTION

1. Field of the Invention

The present invention relates to a system for controlling circulation of developing liquid, which includes a processing tank holding therein developing liquid for developing photosensitive material, an auxiliary tank communicated with an upper region of the developing tank, a circulating passage communicating between the auxiliary tank and a lower region of the processing tank, and a circulating pump for providing circulation of the developing liquid from the upper region of the processing tank through the auxiliary tank, the circulating passage, the lower region of the processing tank then back to the upper region of the processing tank.

2. Description of the Related Art

A photographic developing device for developing photosensitive material such as a photographic film or a print paper includes a processing tank in which processing liquid is held. As the photosensitive material is caused to travel through the liquid, chemical reaction takes place between the processing liquid and the material, whereby the material is photographically developed. In the course of this, in order to promote the chemical reaction between the processing liquid and the photosensitive material, positive circulation flow of the liquid is generated so as to increase the opportunity of contact between the material and fresher, i.e. un-fatigued processing liquid. This liquid flow is generated by using a circulating pump which creates forced circulation of the processing liquid from an upper region of the processing tank through the auxiliary tank, the circulating passage, the lower region of the processing tank and again to the upper region of the processing tank. Also, in the course of this circulation, replenishing, i.e. fresh processing liquid is supplied from the auxiliary tank into the circulating passage.

However, the generation of such strong pump-forced circulation necessarily causes stirring of the processing liquid, thereby to increase the opportunity of contact between air present adjacent the surface of the liquid and this processing liquid which tends to deteriorate by oxidation. Therefore, such forceful circulation arrangement has been disadvantageous in that it tends to accelerate oxidation deterioration of the processing liquid.

SUMMARY OF THE INVENTION

A primary object of the present invention is to provide an improved system for controlling circulation of processing liquid having the two contradictory effects of promoting reaction between processing liquid and photosensitive material and of accelerating of oxidation deterioration of the processing liquid.

For accomplishing the above-noted object, in the developing liquid circulation controlling system described at the onset, the system according to the present invention comprises: use condition detecting means for detecting at least two differing use conditions of the processing tank including first and second use conditions; and controlling means operatively connected with both the circulating pump and the use condition detecting means for setting the circulating pump to a high circulation amount mode when the use condition detecting means detects the first use condition and alternatively setting the circulating pump to a low circulation amount mode when the use condition detecting means detects the second use condition.

The above controlling system attends to the facts that there exist at least two differing conditions of the processing tank, i.e. one condition (the 'first use condition') in which positive circulation of the processing liquid should be generated within the tank and the other condition (the 'second use condition') in which such positive circulation is not always necessary or desirable. Then, when the positive circulation of the processing liquid is needed, particularly when photosensitive material is present within the processing tank, the circulating pump is set to the high circulation amount mode so as to promote reaction between the processing liquid and the photosensitive material. Whereas, when such positive circulation is not needed or needed only by a very limited degree, the pump is set to the low circulation amount mode so as to minimize oxidation deterioration of the processing liquid.

In comparison with the conventional system in which the circulation pump is constantly operated at a fixed circulation amount, the above-described system of the invention provides the advantage of restricting oxidation deterioration of processing liquid while achieving the same effect of promoting the development reaction between the liquid and the photosensitive material.

According to one aspect of the invention, the use condition detecting means detects presence of the photosensitive material within the processing tank as the first use condition and detects absence of the photosensitive material within the processing tank as the second use condition. With this, the photosensitive material introduced into the processing tank may be subjected to an enhanced development reaction by the positive circulation of the processing liquid. On the other hand, when no photosensitive material is present within the tank, the oxidation deterioration of the processing liquid is restricted advantageously due to absence of strong circulation thereof while a minimum necessary amount of fresh liquid may be replenished via the circulating passage.

According to a further aspect of the present invention, the use condition detecting means includes an entrance detecting sensor for detecting of entrance the photosensitive material into the processing tank and a timer for measuring an estimated time period until the introduced photosensitive material is estimated to leave the processing tank. With this construction, entrance of the photosensitive material is detected by the entrance detecting sensor which may be embodied either as a non-contact type sensor such as an optical sensor or as a contact type sensor such as a limit switch. Upon this detection, the circulating pump is geared into the high circulation amount mode. Also, the timer calculates the estimated time period until estimated exit of the photosensitive material from the tank, thereby to determine the timing at which the circulating pump is switched over from the high circulation amount mode to the low circulation amount mode.

A still further aspect of the present invention suggests that the circulating pump under the high circulation amount mode provides an output about twice greater than that under the low circulation amount mode. With this setting, it is possible to obtain optimum balance among the promotion of reaction of the photosensitive material, the restriction of oxidation deterioration of the processing liquid and minimum yet effective supply of replenishing liquid.

For developing the photosensitive material, there are generally needed a plurality of kinds of processing liquid exemplified by developing liquid, bleaching liquid, fixing liquid, and stabilizing liquid. And, these kinds of liquid are held separately within a plurality of processing chambers formed within the processing tank. Then, the photosensitive material is caused to pass through these chambers one after another. Therefore, in this type of developing apparatus, the circulating pump is to be provided for each kind of processing liquid. Then, the control consideration concerning whether the pump is operated under the high circulation amount mode or the low circulation amount mode should be made in accordance with a signal from the use condition detecting means for detecting at least two differing use conditions of each processing chamber.

Preferably, the first and second use conditions based on which each circulating pump is controlled relate respectively to presence and absence of the photosensitive material within each processing tank. In this, if the use condition detecting means includes an entrance detecting sensor for detecting entrance of the photosensitive material into the first one of the processing chambers for first processing the photosenstive material and a timer for measuring estimated time periods spanning from entrance to exit of the photosenstive material to and from the respective processing chambers; then, the presence/absence of the photosensitive material within each processing chamber may be determined by means of the single entrance detecting sensor and the single timer. So that, the construction of the control system may be made simple advantageously.

Further and other objects, features and effects of the invention will become more apparent from the following more detailed description of the embodiments of the invention with reference to the accompanying drawings.

DESCRIPTION OF THE PREFERRED EMBODIMENTS

Next, preferred embodiments of the present invention relating to an automatic film developing apparatus 1 will be described with reference to the accompanying drawings.

Figure 1:
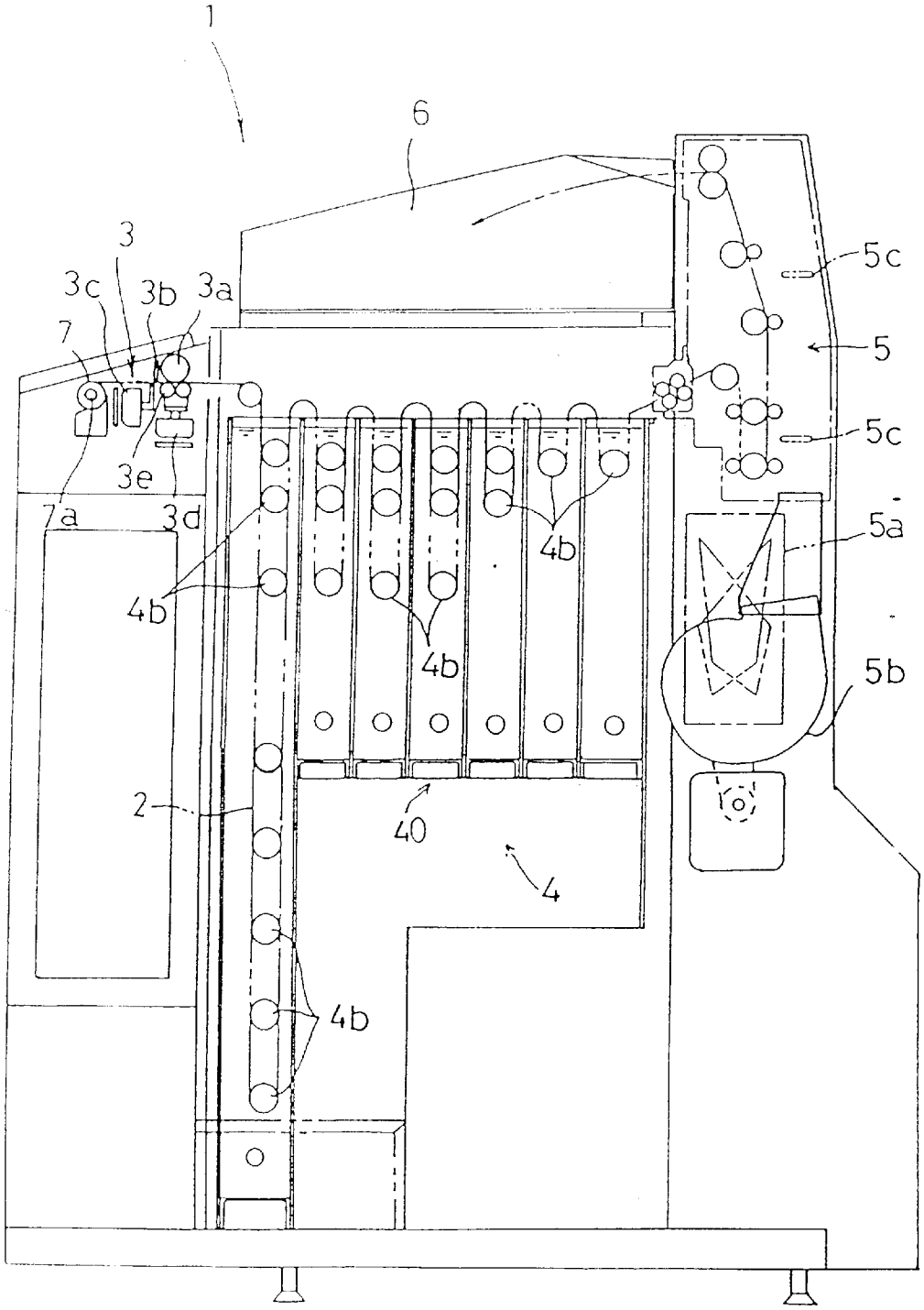
FIG. 1 in overall construction view of an automatic film developing apparatus employing a developing liquid circulation controlling system relating to one preferred embodiment of the present invention.

As shown in FIG. 1, the automatic film developing apparatus 1 includes a film loading section 3 for loading a film 3 (an example of photosensitive material) with a leader connected to a leading end thereof, a film developing section 4 for developing the film 2 fed from the film loading section 3, a film drying section 5 for drying the developed film 2, and a film receiver section 6 for temporarily holding the film 2 after its drying operation.

The film loading section 3 includes a transport roller 3*a*, a film cutter 3*b* for cutting off a trailing end of the film 2 which has been entirely withdrawn from a film patrone 7, a film cutting solenoid 3*c* for slidably driving one of paired cutter blades of the film cutter 3*b*, a free roller 3*e* operable, under a pressing state thereof, to press the film 2 against the transport roller 3*a*, and a pressing solenoid 3*d* for switching over the free roller 3*e* between the pressing state and a non-pressing state by vertically moving this roller 3*e*. The film 2 entirely withdrawn from and cut off the patrone 7 is transported as being pinched between the transport roller 3*a* and the free roller 3*e* to be introduced into the film developing section 4.

The film developing section 4 includes a processing tank 40 having total 7 (seven) separate chambers for individually holding therein a plurality of kinds of processing liquid such as developing liquid, bleaching liquid, fixing liquid, stabilizing liquid and so on for effecting a series of processing steps such as development, bleaching, fixation and so on. The developing section 4 also includes a plurality of transport roller units 4*b* for transporting the film 2 within this developing section 4. The film drying section 5 disposed at a downstream position in a film transport passage relative to the film developing section 4 includes a drying heater 5*a* for drying the film 2, a drying fan 5*b* for supplying hot air to the film transport passage and a temperature sensor 5*c* for detecting the temperature inside the film drying section 5. So that, through this film drying section 5, the film 2 is transported while being dried gradually. Then, this dried film 2 is discharged to the film receiver section 6.

Figure 2:
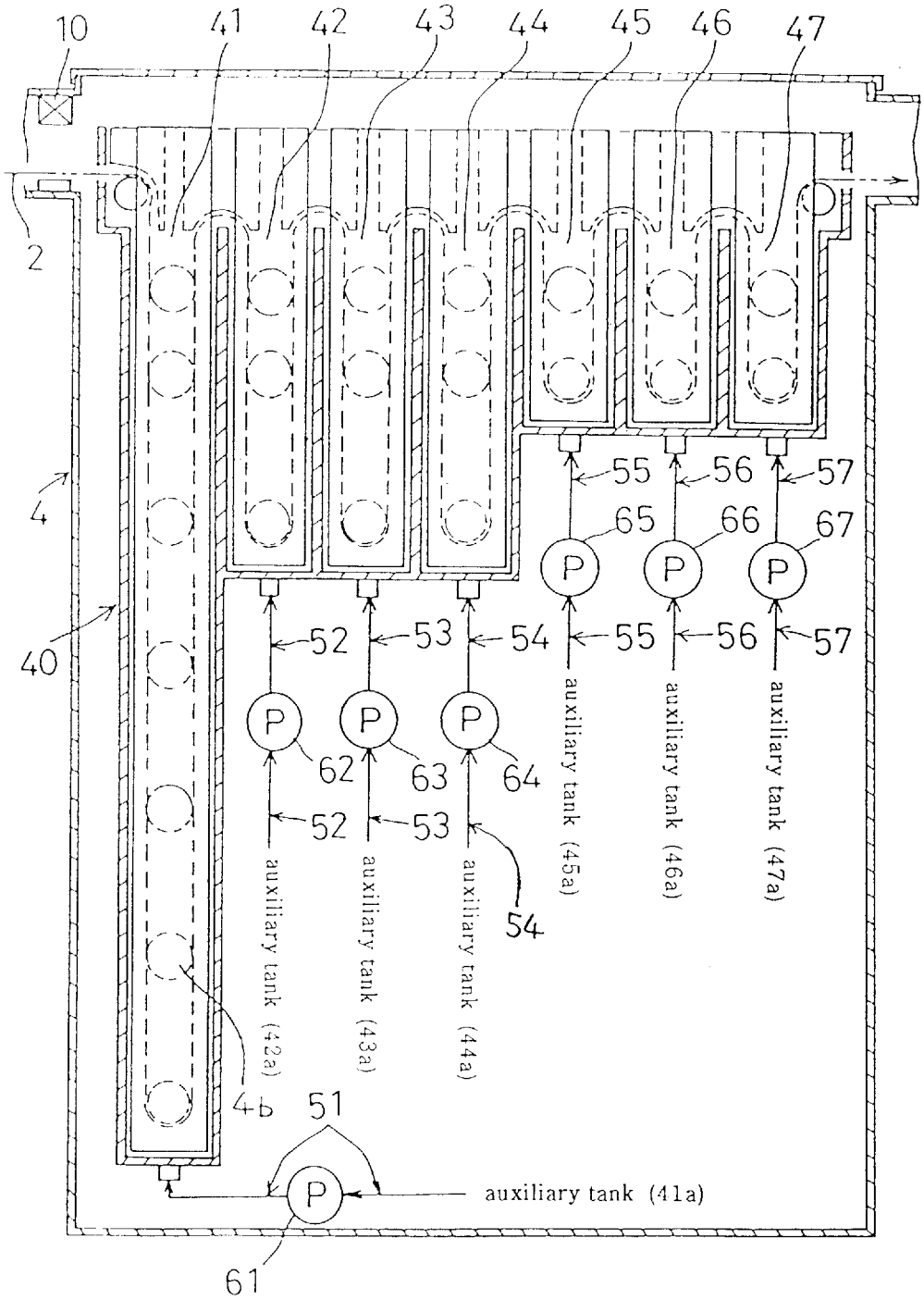
FIG. 2 is a schematic section view of a film developing section of the automatic film developing apparatus of FIG. 1.
Figure 3:
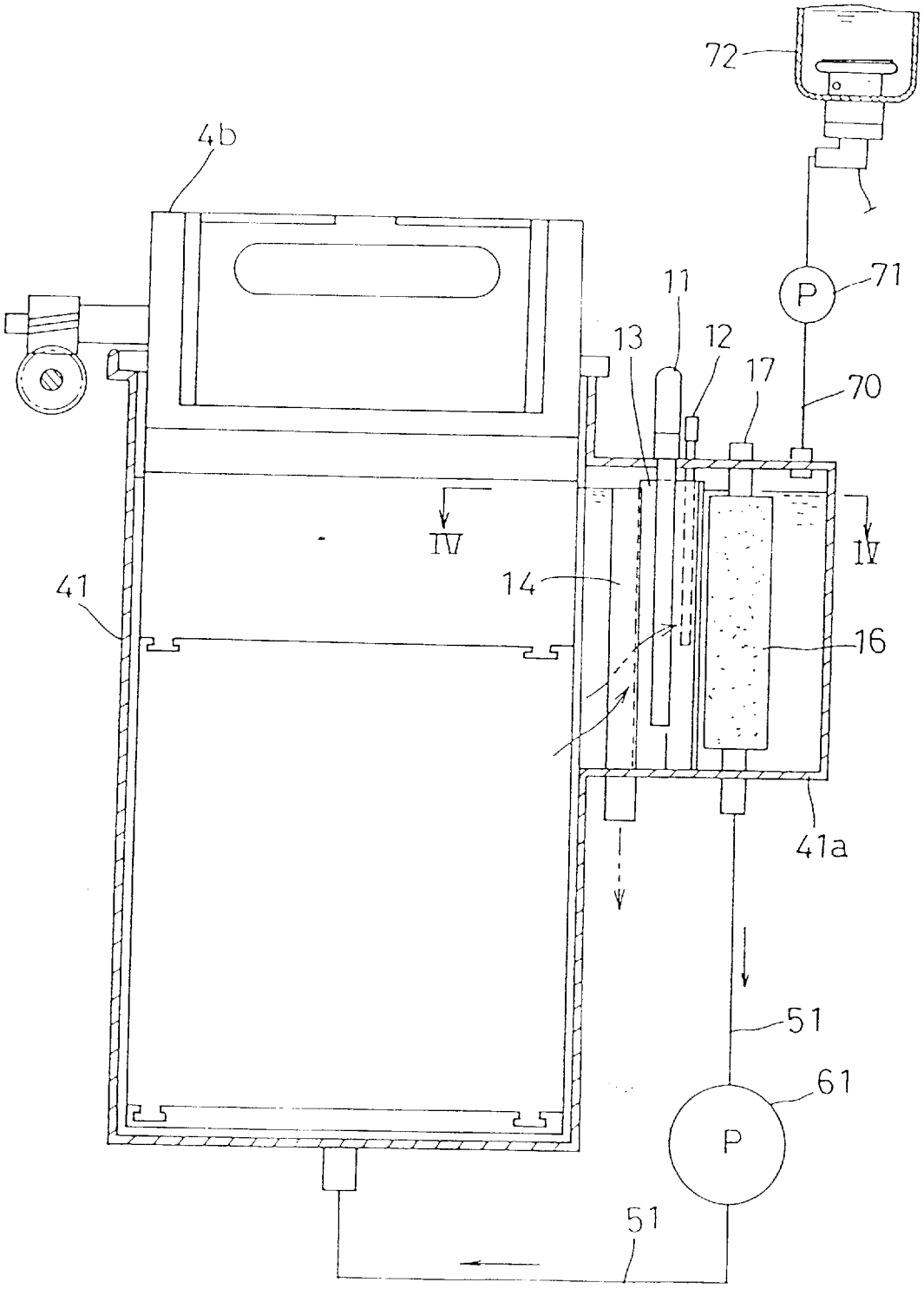
FIG. 3 is a schematic section view of a development processing tank.
Figure 4:
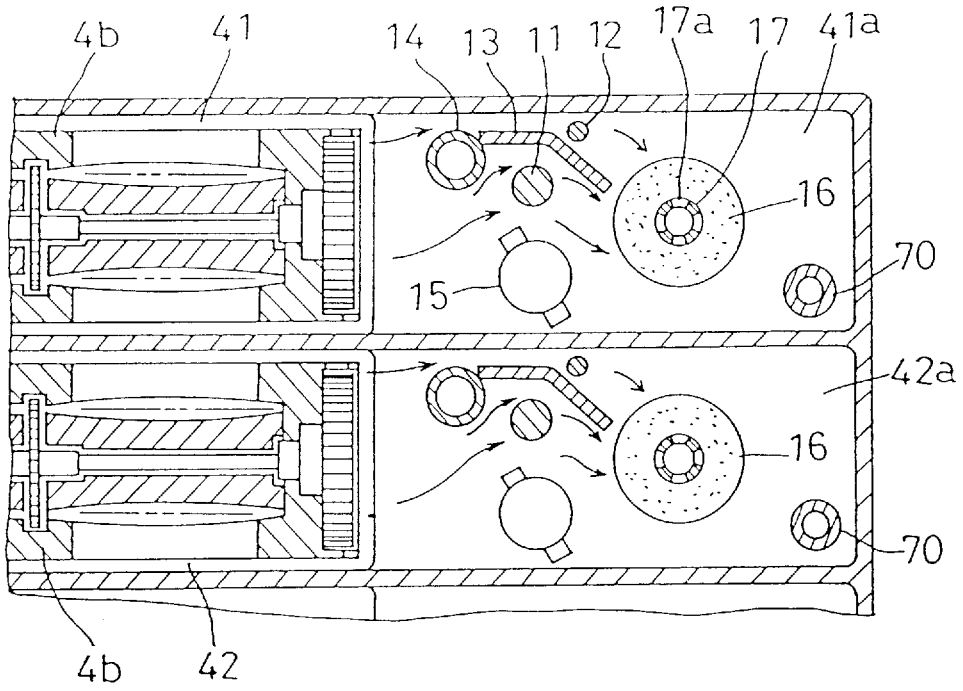
FIG. 4 is a section view taken along a line IV—IV in FIG. 3.

FIG. 2 shows only the film developing section 4 in details. An optical sensor 10 is disposed adjacent an entrance opening of the film developing section 4 for detecting entrance of the film 2 from the film loading section 3. This optical sensor 10 is connected to a control device 100 to be detailed later. As described hereinbefore, the processing tank 40 includes the seven processing chambers 41 through 47. Specifically, seen from the entrance direction of the film 2, first is provided the developing liquid chamber 41 having the greatest depth of all the chambers, and then are provided one bleaching liquid chamber 42 and two fixing liquid chambers 43, 44 which are shallower than the developing chamber 41. Thereafter, three stabilizing liquid chambers 45–47 provided which are the shallowest of all. Except differing in the depths, these chambers 41–47 are constructed otherwise identical. FIG. 3 shows a vertical section of the developing liquid chamber 41 and FIG. 4 shows a horizontal section of the same chamber 41 and of the bleaching liquid chamber 42, respectively.

The developing chamber 41 includes, beside an upper region thereof, an auxiliary tank 41*a*, with the upper region of the chamber 41 and the auxiliary tank 41*a* being communicated with each other. The auxiliary tank 41*a* is communicated also with a bottom of the chamber 41 via a circulating passage 51 which incorporates therein a circulating pump 61. Inside the auxiliary tank 41*a*, there are provided a heater 11 for heating the developing liquid, a temperature sensor 12 for detecting temperature of the developing liquid, a partition plate 13 interposed between the heater 11 and the temperature sensor 12, an overflow pipe 14, a liquid level sensor 15 for detecting the level of the developing liquid, and a filter 16. The heater 11 is controlled so as to maintain the temperature of the developing liquid constant by a feed-back control scheme using the temperature sensor 12. As schematically shown in FIGS. 2 and 3, the auxiliary tank 41*a* is connected with a replenishing pipe 70. Then, in order to maintain constant the developing performance of the developing liquid, a replenishing pump 71 is operated when necessary to replenish additional fresh developing liquid via the pipe 70 from a replenishing tank 72.

The filter 16 is a cylindrical filter having a central bore into which a pipe 17 defining a number slits 17*a* is inserted. In operation, filtered liquid flows through these slits 17*a* into the pipe 17. Further, a lower end of this pipe 17 is communicated with the circulating passage 51. As a result, there is formed a circulation looped line from the upper region of the developing liquid chamber 41, the auxiliary tank 41*a*, the filter 16, the circulating passage 51 incorporating the circulating pump 61, the bottom region of the developing liquid chamber 41 and then back to the upper region of the same, whereby the developing liquid is circulated inside this developing liquid chamber 41. These constructions relating to the auxiliary tank and circulation line are identical for the other chambers also. Hence, the constructions of other chambers will not be described repeatedly.

Figure 5:
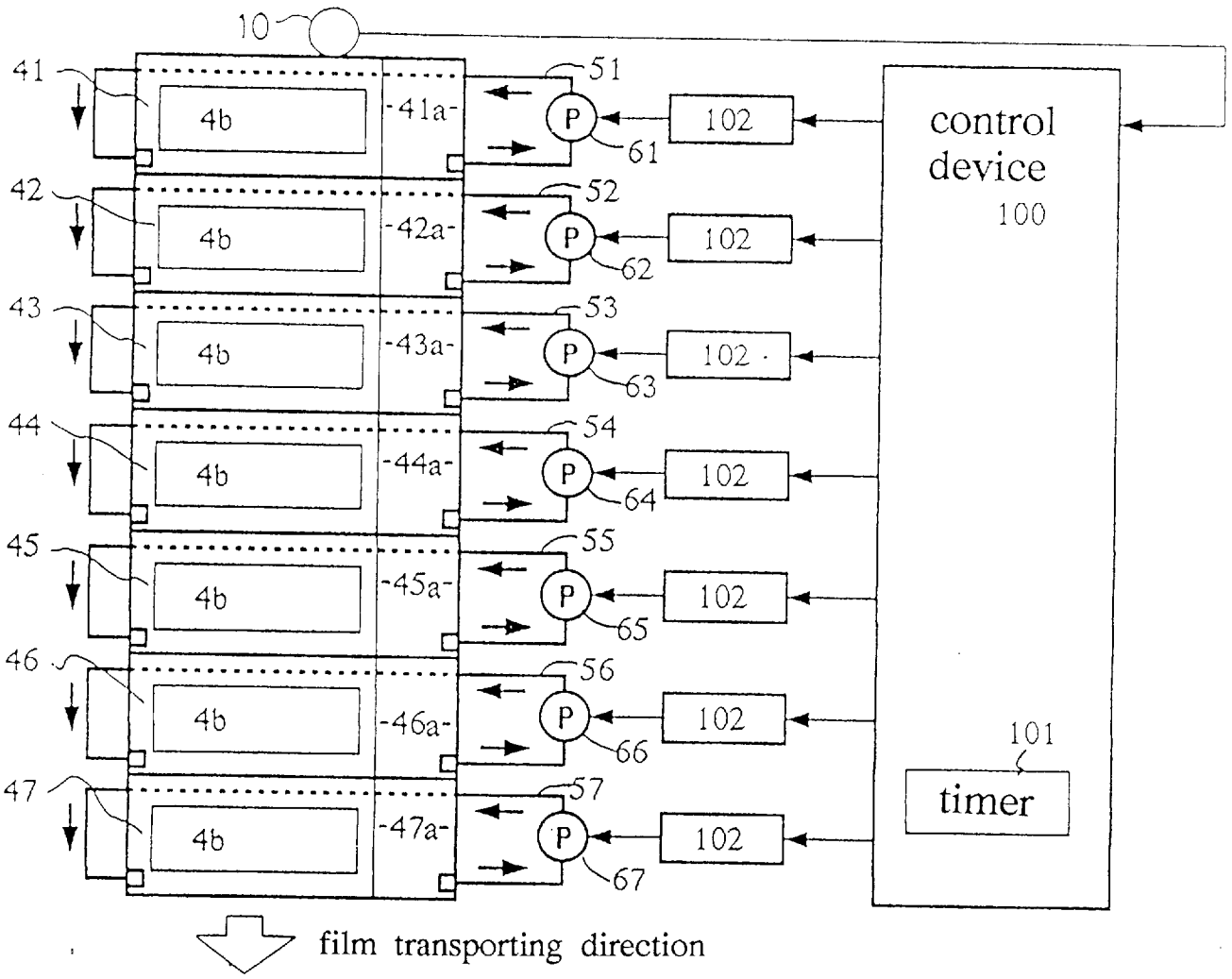
FIG. 5 is a block diagram of the developing liquid circulation controlling system according to the embodiment.

The amount of liquid circulation within the chamber is determined generally by the operational capacity of the circulating pump. In the instant embodiment, the circulating pump is constructed as a variable output type which allows switching-over of its output between two high and low steps under the 5 control of the control device 100. FIG. 5 is a diagram of this circulation amount control system. As may be apparent from this figure, the respective chambers 41–47 and their corresponding auxiliary tanks 41*a*–47*a* are communicated with each other via respective circulating passages 51–57. And, these circulating passages 51–57 incorporate first through seventh circulating pumps 61–67, respectively. These circulating pumps 61–67 are switched over between the two steps of high and low output states via respective pump drivers 102 by the control device 100. That is, the control device 100 and the pump drivers 102 together constitute circulation amount controlling means using the circulating pumps 61–67.

In the present embodiment, the high/low two step switchover of the circulating pump is effected in such a manner that the pump is operated under the high circulation amount mode in the case of a first use condition where a film to be processed is present within the corresponding chamber and the pump is operated under the low circulation amount mode in the case of a second use condition where a film to be processed is not present within the corresponding chamber. The detection of these two distinct conditions is made by the control device 100 using a timer 101. This timer 101 calculates a time period in which the film is expected to stay within the respective chamber, based on a detection signal from the optical sensor 10 constituting a use condition detecting means, with the time period being calculated from the moment of receiving this detection signal.

Figure 6:
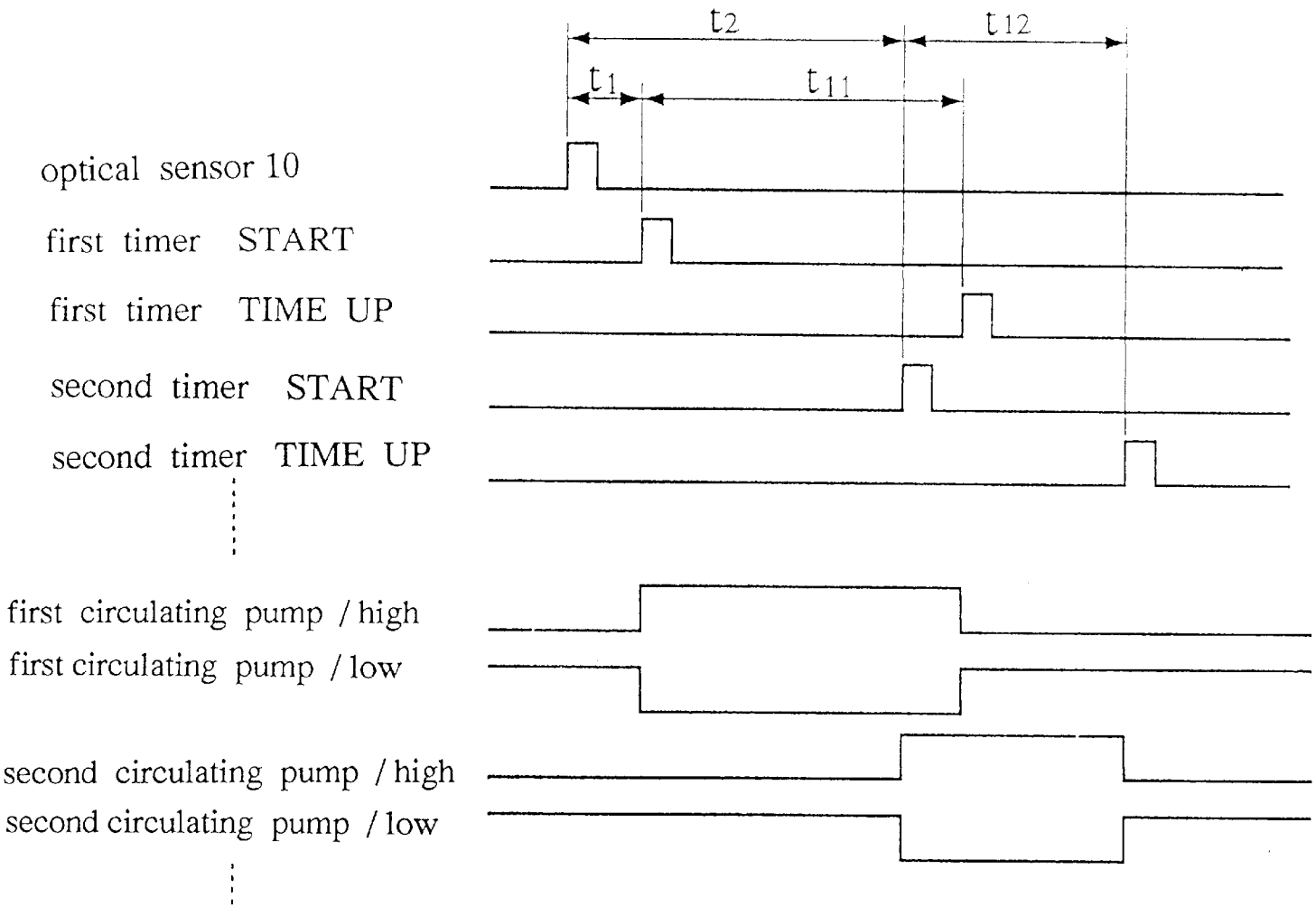
FIG. 6 is a schematic timing chart relating to the controlling system.

More particularly, as may be clearly understood from a timing chart of FIG. 6, first, upon lapse of an estimated time period t1 spanning from reception from the optical sensor 10 of the signal indicating the detection of the film 2 to transport of the film 2 from the position of the optical sensor 10 to the developing liquid chamber 41, a first timer for the first circulating pump 61 is started. Synchronously with this start of the first timer, a high output control signal for the first circulating pump 61 is transmitted to the driver 102, such that the first circulating pump 61 is geared into the high circulation amount mode to render the chamber 41 into a high liquid circulation condition. Next, upon lapse of an estimated time period t2 spanning from the departure of the film 2 from the position of the optical sensor 10 to expected arrivial thereof at the second chamber, i.e. bleaching liquid chamber 42, a second timer for the second circulating pump 62 is started. Synchronously with this start of the second timer, a high output control signal for the second circulating pump 62 is transmitted to its corresponding driver 102, such that the second circulating pump 62 is geared into the high circulation amount mode to render the chamber 42 into the high liquid circulation condition. With lapse of an estimated time period t11 spanning from the entrance of the leading end of the film 2 into the chamber 41 and expected exit of the trailing end of the film 2 from the chamber 41, the first timer times up, upon which timing the high output control signal to the first circulating pump 61 is terminated and a low output control signal instead is outputted to the driver 102, thereby to render the chamber 42 into a low liquid circulation condition. The other circulating pumps 63–67 are operated in the same manner as described above. Therefore, for avoiding redundancy, the timing chart of FIG. 6 shows timing control of the first and second circulating pumps only.

In the manner described above, with entrance of the film 2 into each chamber, the corresponding circulating pump is switched over from the low circulation output mode to the high circulation output mode, whereby the chamber is operated under the high liquid circulation condition. Also, with exit of the film 2 from the chamber, the circulating pump is switched over from the high circulation amount mode to the low circulation amount mode, whereby the chamber is operated under the low liquid circulation condition.

The high circulation amount and low circulation amount may vary, depending on such factors as the capacity of the processing tank 40, or any other processing condition. Yet, it has been experimentally confirmed that if such factor as uniformity of the quality of the developing liquid is to be considered, then, in general the high circulation amount should correspond to the usual circulation amount for effecting a devloping operation and the low circulation amount should correspond to about a half of this high circulation amount. In any case, in comparison with the conventional system which constantly operates at the high circulation amount condition, the invention's system, which selectively provides the low circulation amount mode when needed, provides the advantage of restricting oxidiation deterioration of the processing liquid.

The timer is provided in the form of a software stored in a microcomputer constituting the control device 100, so that the estimated time periods described above are adjustable in order to cope with differences in the film length, film transport speed and the like. Moreover, the control device 100 has a switch for dummy or manual forced setting of either the first use condition or the second use condition regardless of the presence/absence of a film inside a chamber, so as to allow a desired chamber to be circulated at the high or low circulation amount condition for a desired period of time.

In the foregoing embodiment, the presence/absence of a film within a chamber is determined based on a detection signal from the optical sensor for detectig entrance of a film into the processing tank 40 and the expected time period measured thereafter until the exit of the film therefrom. Instead, it is also within the scope of the present invention to provide a film detecting sensor for each chamber.

Further, in the foregoing embodiment, the high/low circulation amount switch-over is effected for each and every circulating pump. Instead, this switch-over may be effected for only one or some of the circulating pumps as needed.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A system for controlling circulation of developing liquid comprising:

a plurality of processing tanks in series for storing a developing liquid for developing photosensitive material;

a plurality of auxiliary tanks, each of said auxiliary tanks communicating with an upper region of each processing tank;

a circulating passage communicating between each auxiliary tank and a lower region of each processing tank;

a plurality of circulating pumps for generating circulation of the developing liquid from the upper region of the processing tank through the auxiliary tank, the circulating passage, the lower region of the processing tank than back to the upper region of the processing tank, said circulating pump being provided in correspondence with each said circulating passage;

use condition detecting means for detecting at least two use differing conditions of the processing tank including first and second use conditions; and controlling means operatively connected with each of said circulating pumps and the use condition detecting means for setting each circulating pump to a high circulation amount mode when the use condition detecting means detects the first use condition and alternatively setting each circulating pump to a low circulation amount mode when the use condition detecting means detects the second use condition wherein said high circulation amount is substantially twice greater than said low circulation amount.

2. A system for controlling circulation of developing liquid, comprising:

a tank unit including a plurality of processing chambers in series for individually holding therein a plurality of processing liquids for serially processing photosensitive material for developing the material;

a plurality of auxiliary tanks provided in correspondence with the processing chambers, each auxiliary tank being communicated with an upper region of the corresponding processing chamber;

a circulating passage communicating between the auxiliary tank and a lower region of the processing chamber;

a plurality of circulating pumps for generating circulation of the developing liquid from the upper region of the processing chamber through the auxiliary tank, the circulating passage, the lower region of the processing tank then back to the upper region to the processing tank, each one of said circulating pumps being provided in correspondence with each of said circulating passages;

use condition detecting means for detecting at least two use differing conditions of the processing chamber including first and second use conditions, said use condition detecting means comprising an entrance detecting sensor for detecting entrance of the photosensitive material into the first one of the processing chambers for first processing the photosensitive material, and a plurality of timers including a first timer, said first timer capable of measuring estimated time periods spanning from entrance to exit of the photosensitive material to and from said first processing chamber based on said detection of the photosensitive material by said entrance detecting sensor, and said plurality of timers other than said first timer capable of measuring estimated time periods spanning from entrance to exit of the photosensitive material to and from the other processing chamber disposed at a downstream position of said first processing chamber based on said detection of the photosensitive material by said entrance detecting sensor; and controlling means operatively connected with said each circulating pump and the use condition detecting means for setting each circulating pump to a high circulation amount mode when said use condition detecting means detects the first use condition and alternatively setting each circulating pump to a low circulation amount mode when said use condition detecting means detects the second use condition.

3. A system according to claim 2, wherein the use condition detecting means detects presence of the photosensitive material within the processing chamber as the first use condition and detects absence of the photosensitive material within the processing chamber as the second use condition.

4. A system according to claim 3, wherein the use condition detecting means includes an entrance detecting sensor for detecting the entrance of the photosensitive material into the first one of the processing chambers for first processing the photosensitive material, and a timer for measuring estimated time periods spanning from entrance to exit of the photosensitive material to and from the respective processing chambers.

5. A system for controlling circulation of developing liquid comprising:

a plurality of processing tanks in series for storing a developing liquid for developing photosensitive material;

a plurality of auxiliary tanks, each of said auxiliary tanks communicating with an upper region of each processing tank;

a circulating passage communicating between each auxiliary tank and a lower region of each processing tank;

a plurality of circulating pumps for generating circulation of the developing liquid from the upper region of the processing tank through the auxiliary tank, the circulating passage, the lower region of the processing tank than back to the upper region of the processsing tank, said circulating pump being provided in correspondence with each said circulating passage;

use condition detecting means for detecting at least two use differing conditions of the processing tank including first and second use conditions, said use condition detecting means comprising a) an entrance detecting sensor for detecting entrance of the photosensitive material into the first one of the processing tanks for first processing the photosensitive material, b) a first timer for measuring estimated time periods spanning from entrance to exit of the photosensitive material to and from said first processing tank, and c) a second timer for measuring estimated time periods spanning from entrance to exit of the photosensitive material to and from a second processing tank; and controlling means operatively connected with each of said circulating pumps and the use condition detecting means for setting each circulating pump to a high circulation amount mode when the use condition detecting means detects the first use condition and alternatively setting each circulating pump to a low circulation amount mode when the use condition detecting means detects the second use condition, wherein the use condition detecting means detects presence of the photosensitive material within the processing tank as the first use condition and detects absence of the photosensitive material within the processing tank as the second use condition.

* * * * *